US008821164B2

(12) United States Patent
Valdez

(10) Patent No.: US 8,821,164 B2
(45) Date of Patent: Sep. 2, 2014

(54) DECORATIVE CANISTER

(76) Inventor: Gerardo Valdez, Houston, TX (US)

( * ) Notice: Subject to any disclaimer, the term of this patent is extended or adjusted under 35 U.S.C. 154(b) by 879 days.

(21) Appl. No.: 12/154,769

(22) Filed: May 27, 2008

(65) Prior Publication Data

US 2009/0294314 A1 Dec. 3, 2009

(51) Int. Cl.
*G09B 11/00* (2006.01)

(52) U.S. Cl.
USPC ..... 434/81

(58) Field of Classification Search
USPC ..... 434/81, 82, 84, 95, 96; 220/62.14, 660, 220/694, 737; 221/45; 206/394; 156/1
See application file for complete search history.

(56) References Cited

U.S. PATENT DOCUMENTS

| | | | | | |
|---|---|---|---|---|---|
| 1,237,914 | A * | 8/1917 | Kunath | 220/660 |
| 1,421,628 | A * | 7/1922 | Watkins | 220/9.4 |
| 3,507,312 | A * | 4/1970 | Petersen | 220/737 |
| 5,305,907 | A * | 4/1994 | Richardson et al. | 220/694 |
| 5,325,986 | A * | 7/1994 | Richardson et al. | 220/694 |
| 5,562,229 | A * | 10/1996 | Callahan | 220/694 |
| 5,636,890 | A * | 6/1997 | Cooper | 296/37.1 |
| 5,865,407 | A * | 2/1999 | Effa | 248/164 |
| 6,112,936 | A * | 9/2000 | Arizmendi | 221/45 |
| 6,508,377 | B1 * | 1/2003 | Griswold et al. | 220/495.06 |
| 6,834,773 | B2 * | 12/2004 | Wu | 221/45 |

* cited by examiner

*Primary Examiner* — Kurt Fernstrom
(74) *Attorney, Agent, or Firm* — Delphine James

(57) ABSTRACT

The present invention is a decorative canister comprising a container further defined by an opened top end and a closed bottom end. A lid is hingedly connected to the opened top end. However, the lid can be non-connected. Decorative fabric surrounds the outer surface area of the sidewall. Decorative ornaments are attached at predetermined locations to the decorative fabric.

14 Claims, 16 Drawing Sheets

DECORATIVE CANISTER

BACKGROUND

This invention relates to decorative accessories for homes. More specifically, this invention relates to decorative canisters for use in bathrooms. There are several different type of canisters designed to hold multiple stackable items. However, the concept method of a decorative canister coordinated with the bathroom décor along with the method is unique and novel concept.

SUMMARY

The present invention is a decorative canister comprising a container, further defined by an opened top end and a closed bottom end. A lid is hingedly connected to the opened top end. However, the lid can be non-connected. A decorative covering or fabric surrounds the outer surface area of the sidewall, and decorative ornaments may be attached at predetermined locations to the decorative fabric.

BRIEF DESCRIPTION OF DRAWINGS

FIG. 7 illustrates the frontal view of the bottom of a container with cap on.

FIG. 9 illustrates the frontal view of the container with the bottom cap and top lid on.

DETAIL SPECIFICATION

Figure 2:
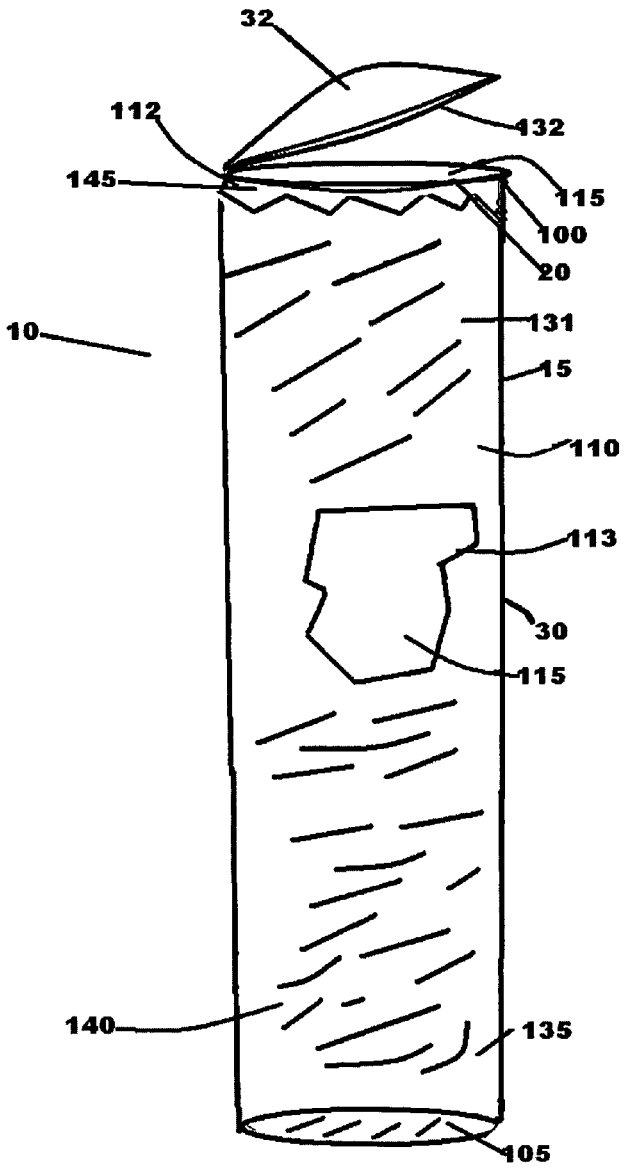
FIG. 2 illustrates the present invention with the lining fabric pulled over the outer edges.

The present invention, a decorative canister (10), includes an elongated container (15) with a lid (32). The container further includes an opened top (100) with a closed bottom (105). Surrounding sidewall (110) is situated between opened top (100) and closed bottom (105). Surrounding sidewall (110) further includes an inner surface area (113) and an outer surface area (30) with a hollow chamber, or cavity formed therein. Cavity (115) is adapted to receive a plurality of items in a stackable arrangement therein. As shown, the lid (32) has an upper surface (130) and a lower surface (132). A decorative fabric (140) is adapted to completely cover the outer surface area (30) of the surrounding sidewall (110) and lid (32). A lining fabric (145) is adapted to completely cover the inner surface area (113) of the surrounding sidewall (110) circumferentially extending over the top edge (100) and bottom edge (105) of canister (15) as shown in FIG. 2. A decorative fabric (140) is adapted to cover the exterior surface area (130) of the lid (32) and the bottom surface area of the lid (32). The exterior surface area (30) of the canister (10) is divided into an upper quadrant (131) and a lower quadrant (135).

Figure 3:
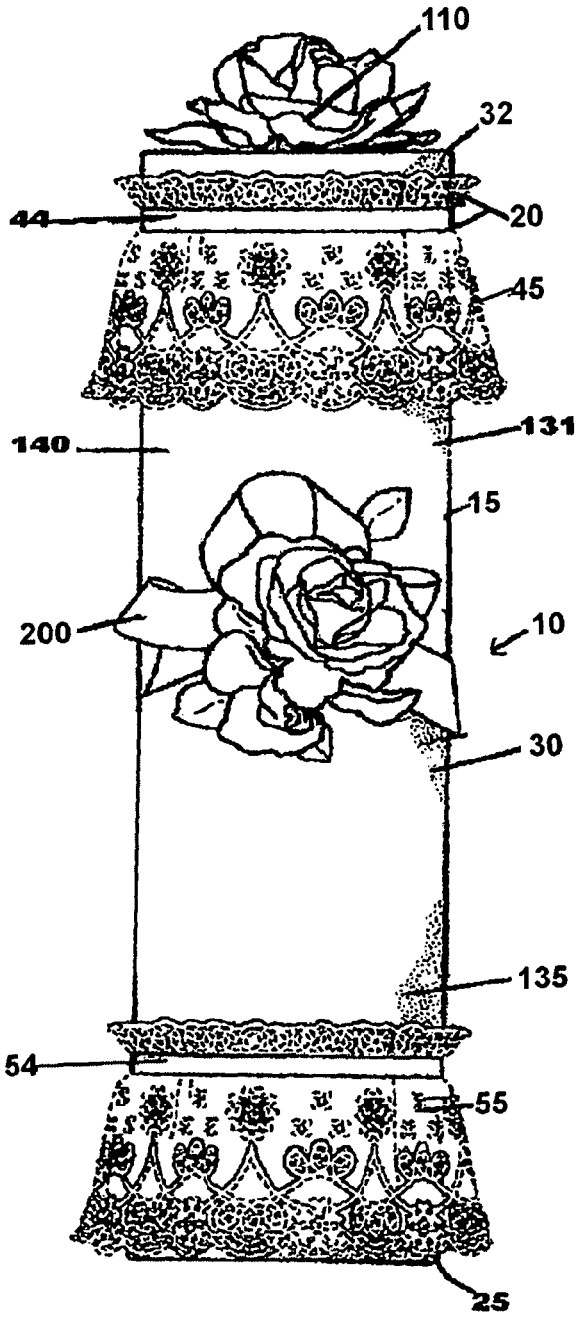
FIG. 3 illustrates a decorated container.
Figure 4:
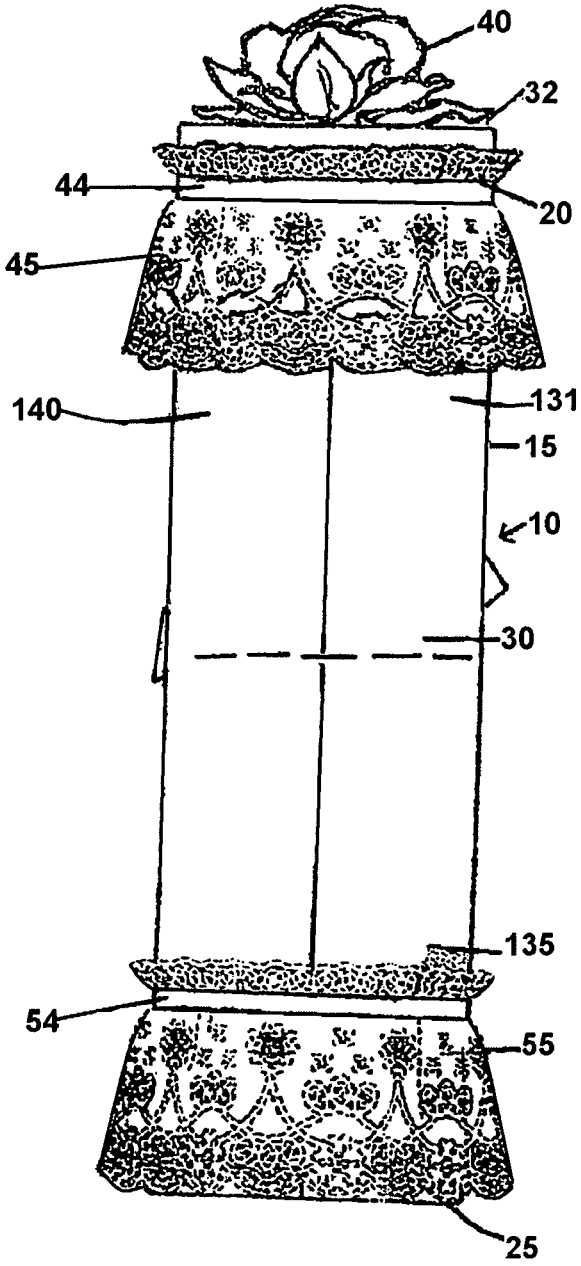
FIG. 4 illustrates the back of a decorated container.

In an embodiment of the present invention, as depicted in FIG. 3, a plurality of decorative items can be attached at predetermined locations in the upper quadrant (131) and the lower quadrant (135). One decorative item (200) can be circumferentially attached along the center area on the decorative fabric (140) attached to the container (15). Another decorative item can circumferentially surround the outer surface area (30) of the opened top (100) on the decorative fabric (140). Another decorative item can circumferentially surround the outer surface area (30) of the bottom end (25) on the decorative fabric (140).

Figure 1:
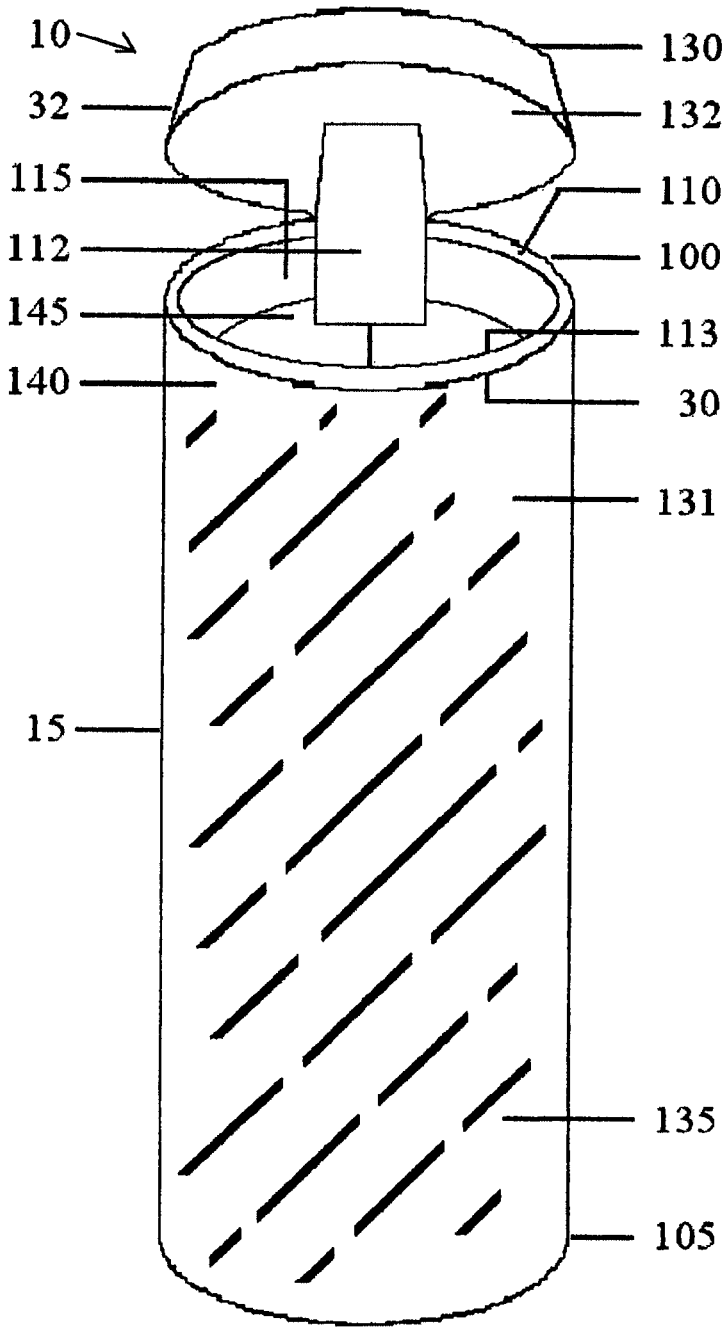
FIG. 1 illustrates the present invention, an opened decorative canister.
Figure 16:
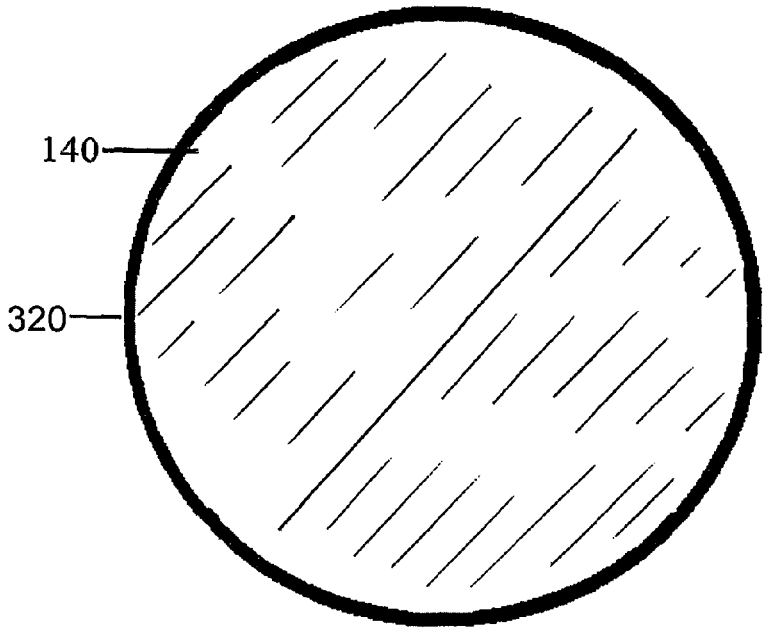
FIG. 16 illustrates a top view of a base plate.
Figure 17:
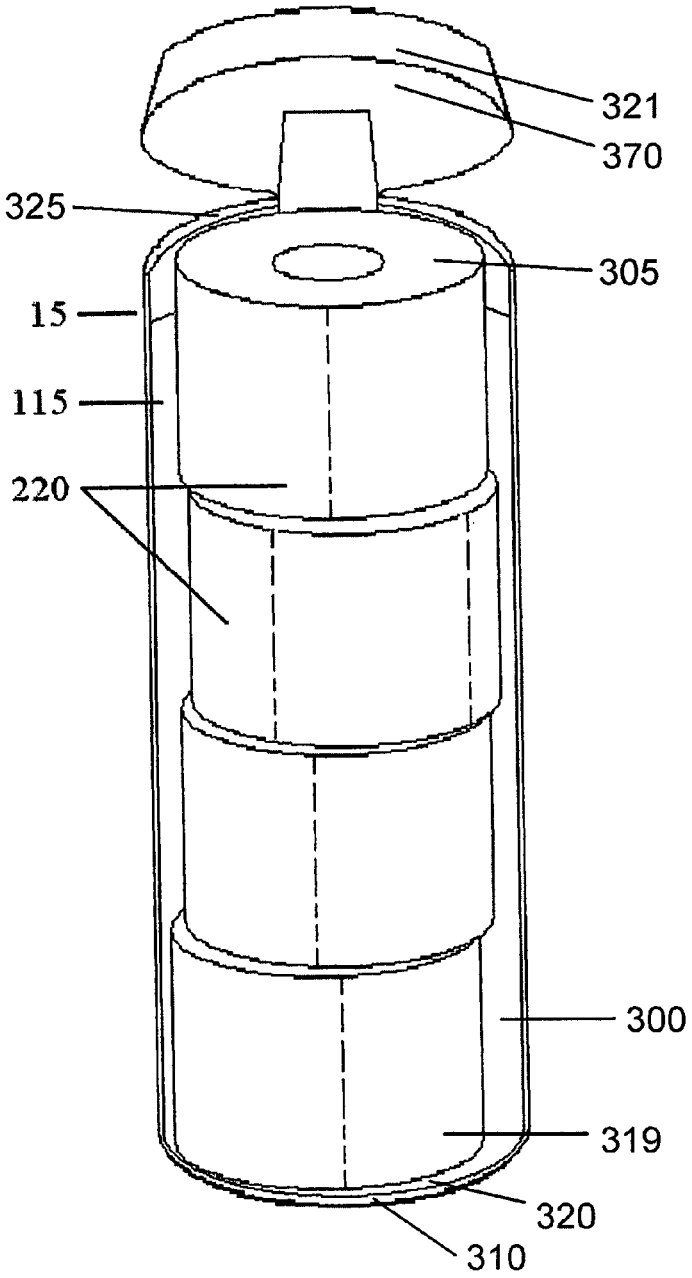
FIG. 17 illustrates a cross-sectional view of a decorated container with stackable items.

As shown in FIG. 1, the container (15) preferably a cylindrical shape. However, the shape of the container (15) is not limited to that shape. As shown in FIG. 17, cavity (115) of container (15) is adapted to receive a plurality of stackable items therein. In the preferred embodiment, the plurality of stackable items (220) are preferably toilet tissue, but can be other suitable items that can be adapted to stack in the container (15). The present invention includes a method of decorating the canister (10) as shown in FIGS. 7-17.

The method includes the steps of:

(a) providing a cylindrical container having an opened top and an opened bottom, with a surrounding sidewall therebetween, a lid, and a cavity formed within the container; the container may have a removable lid that can be inserted and removed into the opened top and bottom.

Figure 7:
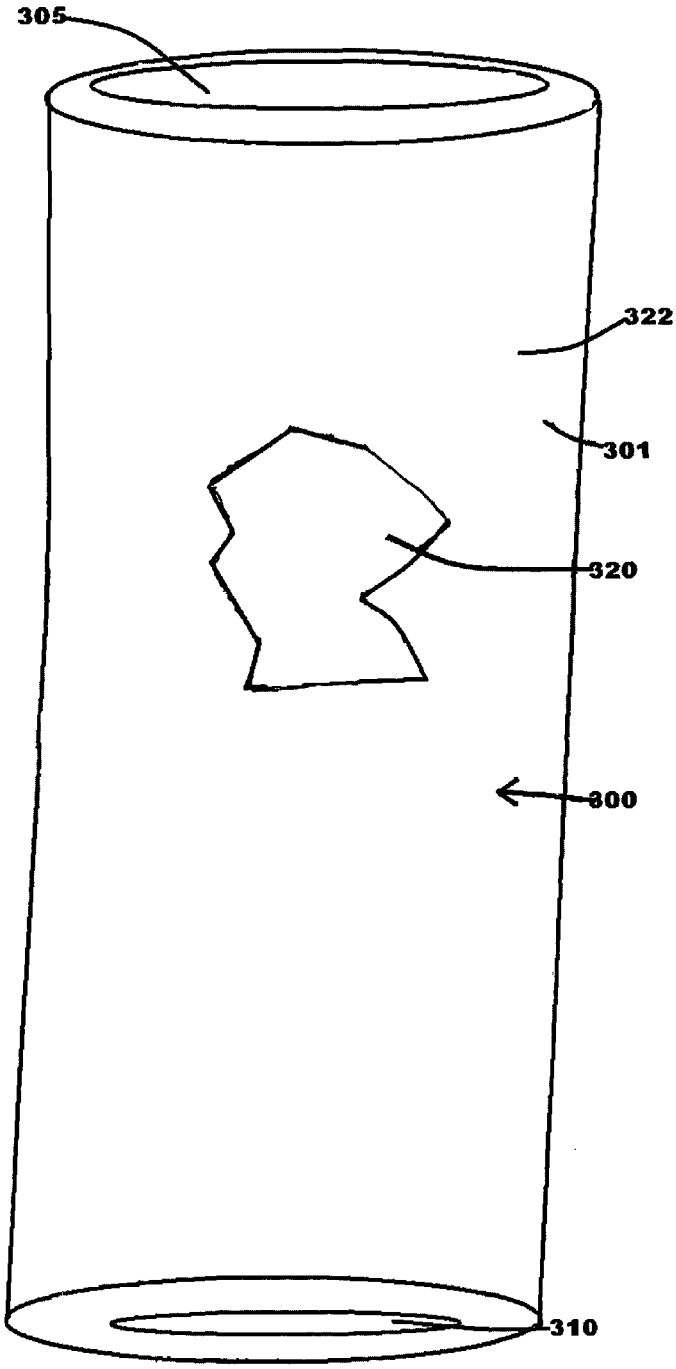
Figure 8:
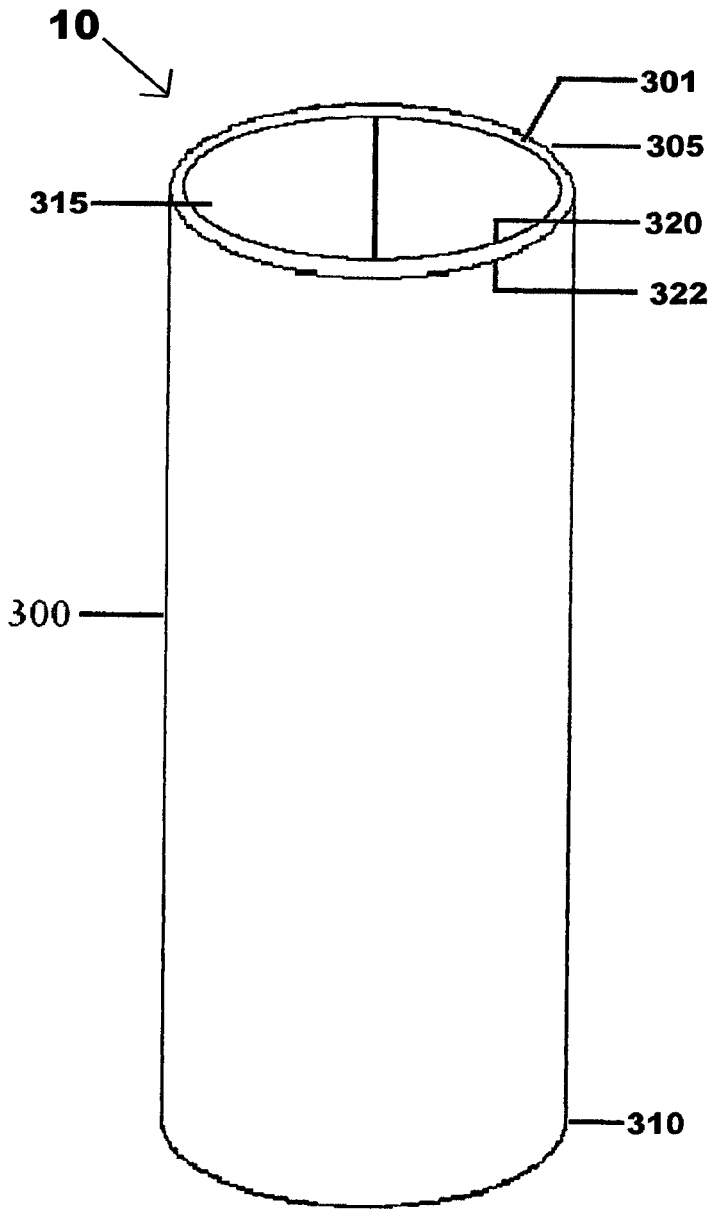
FIG. 8 illustrates the frontal view of the container with the lining fabric on the inner surface area only.

(b) providing lining fabric for covering an inner surface area of the container and sealing the lining fabric to the inner surface area of the container thereto;

(c) pulling the lining fabric over the opened top and bottom circumferentially surrounding the outer surface area of the opened top and bottom, and sealing the lining fabric thereto;

(d) providing decorative fabric for covering an exterior surface area of the container and sealing the decorative fabric to the exterior surface area of the container;

(g) covering the bottom with the decorative fabric; and (h) securing the cap member to the opened bottom end;

(e) covering the lid with a decorative fabric;

(f) covering the secured bottom with decorative fabric; and (g) hingedly connecting the lid to the opened top end of the container;

Referring to FIGS. 7 and 8, there is shown, container (15) which is an elongated cylindrical tube (300) that has a hollow interior chamber and that is defined by an opened top end (305) and an opened bottom end (310) with a surrounding sidewall (301) disposed therebetween. Surrounding sidewall (301) further includes an interior surface area (320) and an exterior surface area (322). The cylindrical tube (300) can be made of metal, card board, or another suitable material. In the preferred embodiment, the hollow interior chamber of tube (300) has a predetermined diameter and length to hold a plurality of toilet tissues or other suitable or stackable items. Yet, the interior chamber of tube (300) can be altered to any diameter or length to house other decorative items. Additionally, interior chamber of tube (300) can be adapted to be an oval or a polygonal in shape.

Figure 8A:
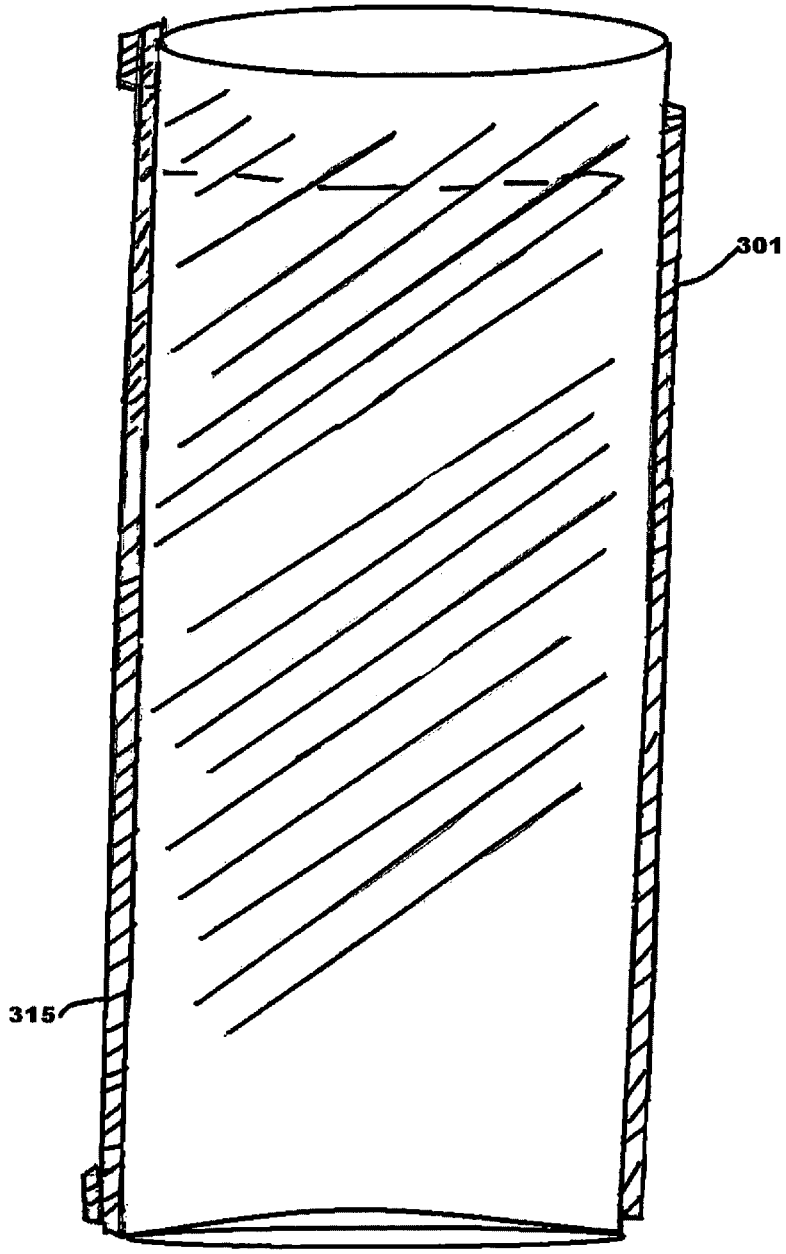
FIG. 8A illustrates the frontal view of the container with lining of the fabric on both the inner and outer surface areas.
Figure 12:
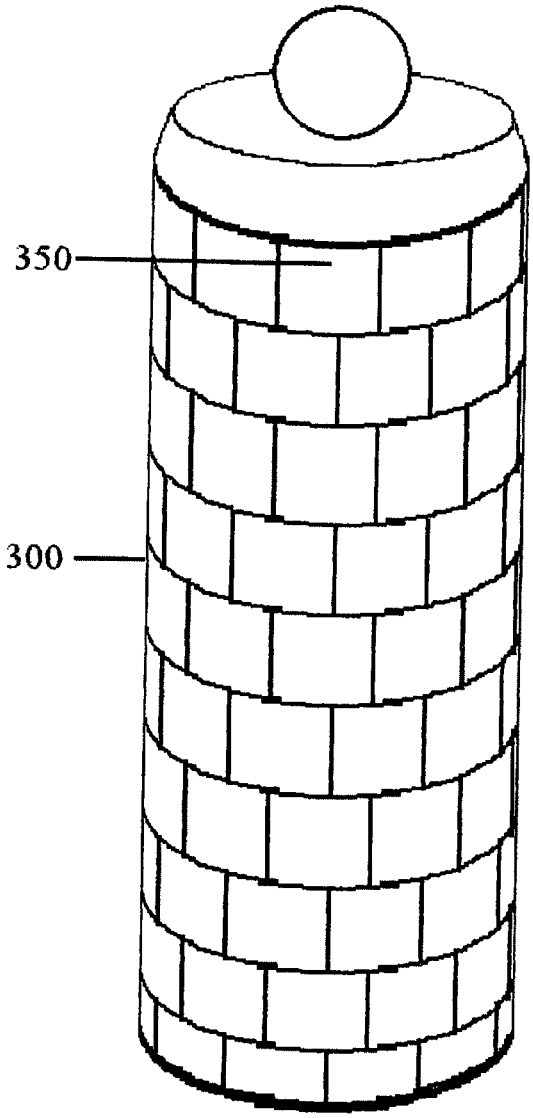
FIG. 12 illustrates the frontal view of the container with decorative covering.

As depicted in FIG. 8, a lining fabric (315) spans the inner surface area of sidewall (301) from to the top end (305) to the bottom end (310) of the tube (300) and is secured thereto. In one configuration, the lining fabric (315) extends over the circumferential edge of the top end (305) and the bottom end (310). In other configurations, the lining fabric (315) extends to the circumferential edge of the opened top end (305) and the opened bottom end (310). In other configurations as shown in FIG. 8A, when required for extra consistency, the lining fabric can span the exterior surface area of the surrounding wall (301). In the preferred embodiment, lining fabric (315) is made from, but is not limited to a stretchable fabric. Then as shown in FIG. 3, the exterior surface area (30) of the surrounding wall (110) is securely covered with a selected decorative fabric (140) or tile (350) as shown in FIG. 12.

As shown in FIG. 7, the opened bottom end (310) is securely closed with a cap member (319). The cap member (319) further includes a flat base plate (323) attached to a dome shaped top (321). The dome shaped top (321) is inserted into the opened bottom (310) to securely seal the opening in bottom end (310). Then, base plate (323) is covered with the selected decorative fabric (140). Next, the outer perimeter of the base plate (323) is securely attached to the outer perimeter of the bottom end (310), thereby securely closing the opening in bottom end (310). As shown in FIG. 16, there is shown a bottom view of the base plate (323) with illustrations that decorative fabric (140) covers the bottom of base plate (323).

Figure 9:
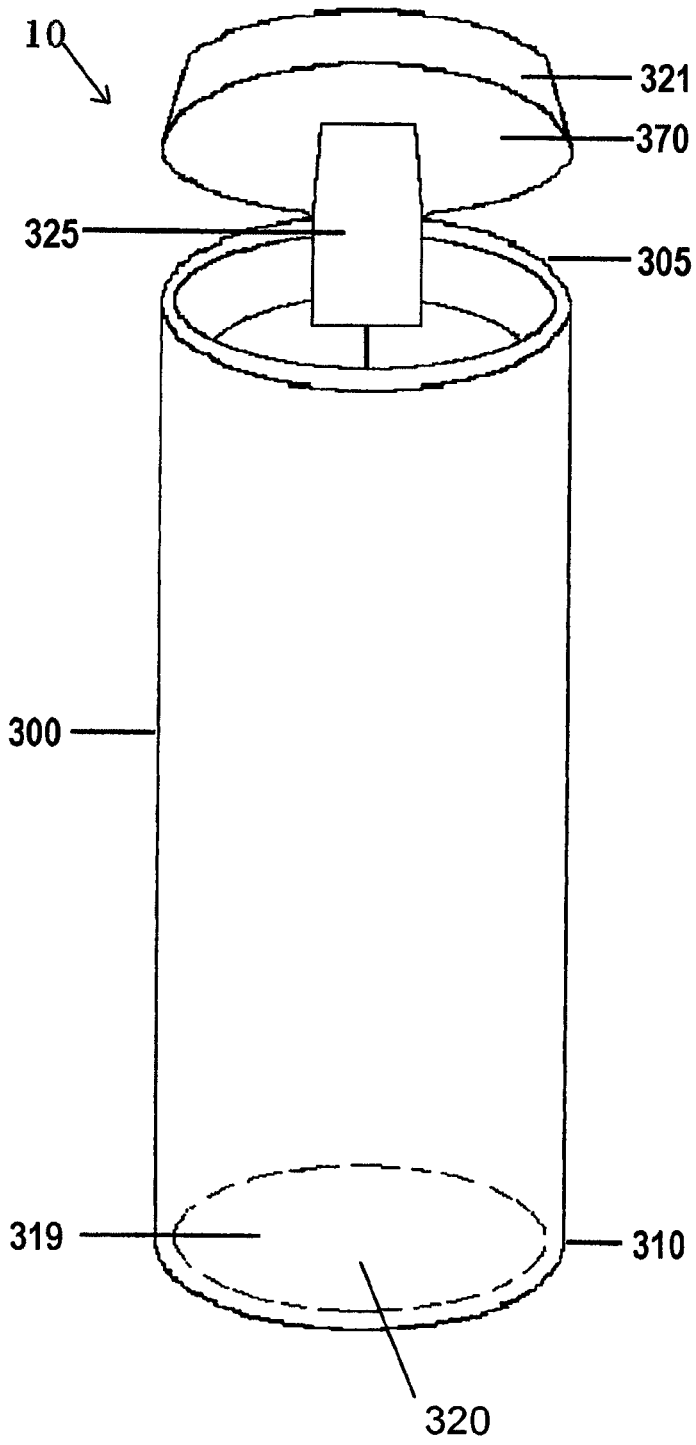
Figure 9A:
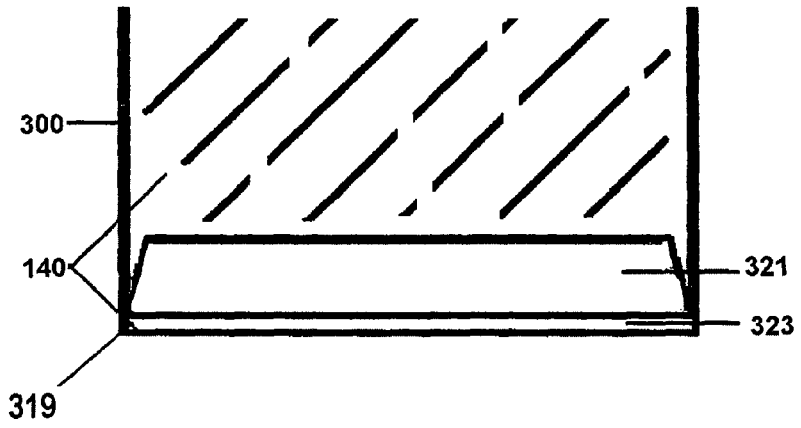
Figure 10:
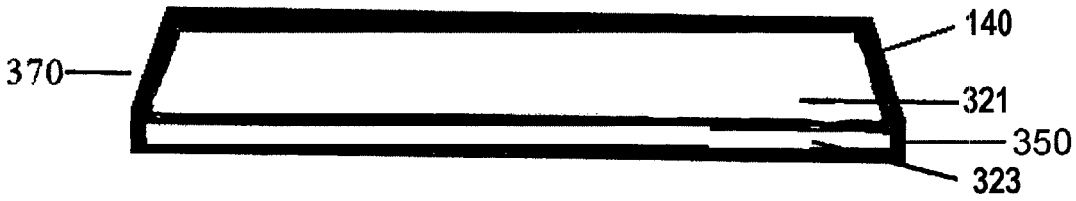
FIG. 10 illustrates the cross-sectional view of the lid.
Figure 11:
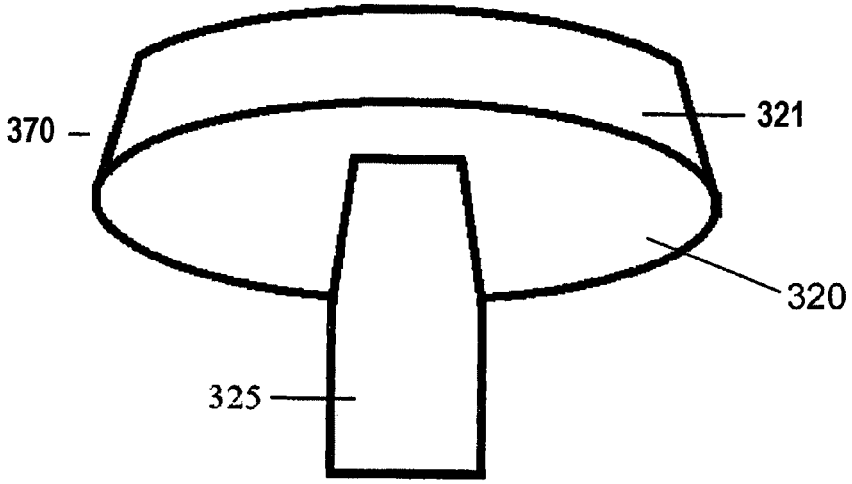
FIG. 11 illustrates the frontal view of the lid.
Figure 13A:
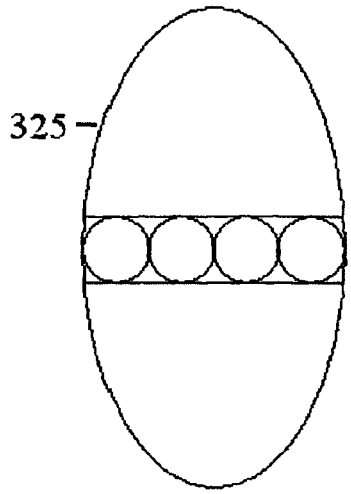
FIGS. 13A-13C illustrates the alternative embodiments of the hinge connection.
Figure 13B:
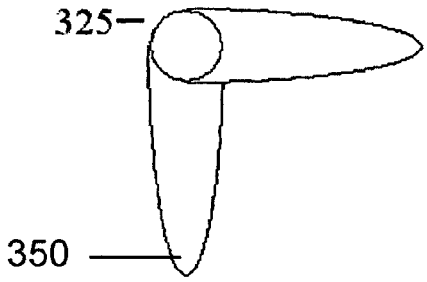
Figure 13C:
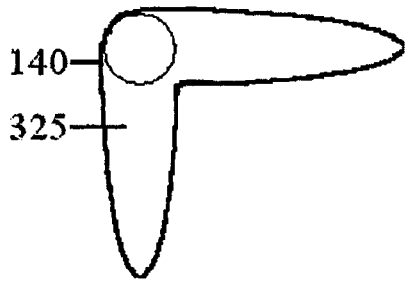

As shown in FIG. 11, there is shown a frontal view of lid (370). As shown in FIG. 9, the opened top end (305) is covered with a special lid (370). FIG. 10 illustrates a cross-sectional view of lid (370). The lid (370) comprises a dome shaped top (321) lying over and secured to base plate (323). The exterior surface of both the dome (321) and the plate (323) is covered with the selected decorative material (140). As shown in FIG. 9, lid (370) can be hingedly connected to upper inner surface of tube (300) by a conventional hinge (325) that can be made of, but is not limited to, metal or cloth. In the preferred embodiment, lid (370) can be hingedly connected to upper inner surface of tube (300) by a cloth hinge (325). FIG. 13A-13C illustrates the various hinges. 13A, illustrates a frontal view of a metal hinge (325). 13B illustrates a profile view of a metal hinge, and 13C illustrates a metal hinge covered with decorative fabric, encompassed with a material. In the preferred embodiment, the material is a terry cloth. However, any suitable material can be used to cover the container including but not limited to, leather, polyester, or cotton.

Figure 14:
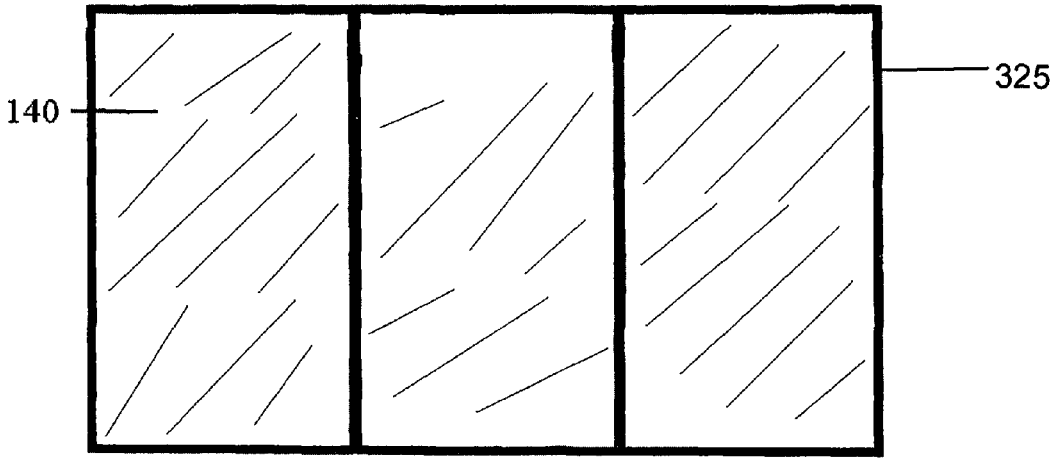
FIG. 14 illustrates a single layer of fabric for the clothing hinge.
Figure 15:
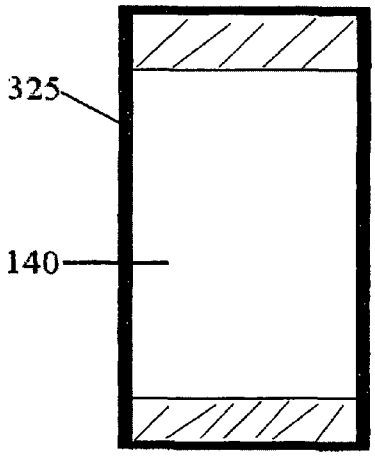
FIG. 15 illustrates the a folded view of a cloth hinge.

As shown in FIG. 14, the hinge (325) is made from a single layer of rectangular shaped decorative fabric (140) folded to create a cloth hinge of several layers. In the preferred embodiment depicted in FIG. 15, cloth hinge (325) is formed into a shape of a rectangle having a predetermined width (W) and length (L) of several layers. Cloth hinge (325) is created from several layers of decorative fabric (140) to form a level of consistency to support the opening and closing of lid upon the inner tube (300) as shown in FIG. 9. The cloth hinge (325) is layered depending upon the thickness of the fabric. In the preferred embodiment, cloth hinge can require at least 3 layers as depicted in FIG. 14.

As shown in FIG. 9, to secure the cloth hinge (325) to the tube (300), one edge of the cloth hinge is secured to the bottom surface of base plate (323) of lid (370) to the inside chamber of the hollow tube (300) near open top end (305). The use of stretchable/fabric allows the lid (370) to automatically close after lifting up the lid.

Referring to FIGS. 3-6. There is shown two different designs for a decorative canister (10). In this decorative embodiment, the decorative canister (10) comprises a cylindrical shape container (15) further defined by an opened top end (20) and a bottom end (25). In the preferred embodiment, a lid (32) is hingedly connected to the opened top end (20). However, the lid (32) can be non-connected.

The entire outer surface area (30) from top end (20) to bottom end 25 of the container (15) is completely encompassed with a decorative material (140). The outer surface area (30) of the lid (32) is completely encompassed with a material. In the preferred embodiment, the material is a terry cloth. However, any suitable material can be used to cover the container including but not limited to leather, polyester, or cotton.

Figure 5:
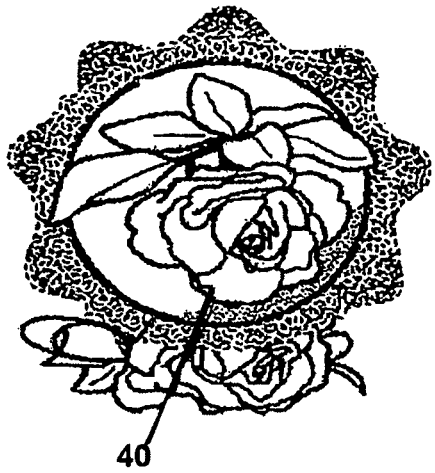
FIG. 5 illustrates the top of a decorated container.
Figure 6:
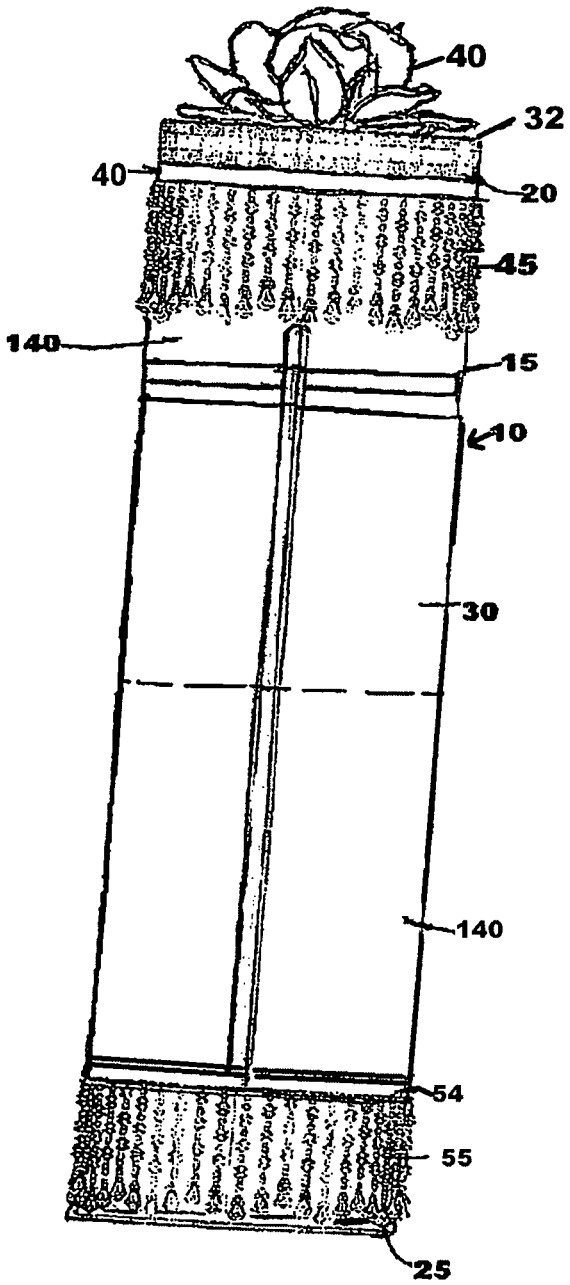
FIG. 6 illustrates the back of a decorated container with beads.

In some embodiments, the canister can be covered with ornaments at strategic locations on the container, lid, or both, as shown in FIGS. 5 and 6. Mounted on top of lid (32). And at an intermediate point on the front area of the container (15), is a decorative ornament (40) with decorative ribbons. The decorative ornament (40) is preferably a plastic flower. Lace (45) of at least, but not limited to, a ½ inch in width can encircle container (15) near top end (25). Ribbon (44) of a substantially less width than lace (45) is overlay the lace (45). Lace (55) of at least, but not limited to, a ½ inch in width can encircle container (15) near bottom end (20). Ribbon (54) of a substantially less width than lace (55) is overlay the lace (55). Referring to FIG. 6, there is shown an alternative embodiment of the present invention. In the alternative embodiment, hanging beads (46) encircle near the top end (20) of container (15) and near the lower end (25) of container (15).

What is claimed is:

1. A method of decorating a canister comprising the steps of:

providing a container having an opened top and an opened bottom with a surrounding sidewall therebetween with a lid, a cavity formed within the container;

providing lining fabric for covering an inner surface area of the container and sealing the lining fabric to the inner surface area of the container thereto;

pulling the lining fabric over the opened top circumferentially surrounding the outer surface area of the opened top and sealing the lining fabric thereto;

providing decorative fabric for covering an outer surface area of the container;

sealing the decorative fabric to the outer surface area of the container;

covering the bottom with the lining fabric;

securing the opened bottom with a cap member;

covering a top surface area of the lid with a decorative fabric; and covering a bottom surface area of the lid with a lining fabric.

2. The method of claim 1 further comprising the step of attaching at least one decorative item at a predetermined location on the decorative fabric.

3. The method of claim 2 further comprising the step of placing at least one flower or ribbons or lace or decorative stones or pictures at a predetermined location on the decorative fabric.

4. A decorative canister produced from the method of claim 1, the canister comprising:

an elongated container with a lid;

the container having an opened top and an opened bottom with a surrounding sidewall;

the surrounding sidewall having an inner surface area and an outer surface area with a cavity therein;

the cavity adapted to received a plurality of items in a stackable arrangement therein;

the lid having an upper surface and a lower surface;

a decorative fabric adapted to completely cover the outer surface area of the surrounding sidewall;

a lining fabric adapted to completely cover the inner surface area of the surrounding sidewall;

the decorative fabric adapted to cover an outer surface area of the lid; and the lining fabric adapted to cover the bottom surface area of the lid wherein the canister is transformed into an aesthetically covered decorative arrangement.

5. The canister of claim 4 wherein the outer surface area of the lid is divided into an upper section and a lower section.

6. The canister of claim 5 wherein at least one decorative item is attached to a predetermined location on the decorative fabric in the upper section on the outer surface of the lid.

7. The canister of claim 5 wherein at least one decorative item is attached to a predetermined location on the decorative fabric in the lower section on the outer surface of the lid.

8. The canister of claim 4 wherein at least one decorative item is attached at a predetermined location on the decorative fabric along the center area of the canister.

9. The canister of claim 4 wherein at least one decorative item circumferentially surrounds and attaches along a center area on the decorative fabric.

10. The canister of claim 4 wherein at least one decorative item circumferentially surrounds and attaches to an outer area of the opened top on the decorative fabric.

11. The canister of claim 4 wherein at least one decorative item circumferentially surrounds and attaches to an outer area of the bottom on the decorative fabric.

12. The canister of claim 4 wherein the container has a cylindrical shape.

13. The canister of claim 4 wherein the container has a rectangular shape.

14. The canister of claim 4 wherein the plurality of items is toilet tissue.

* * * * *